United States Patent [19]

Baravian et al.

[11] Patent Number: 4,518,658

[45] Date of Patent: May 21, 1985

[54] WATERPROOF MEMBRANE WITH FUSE BONDED NON-WOVEN REINFORCEMENT

[75] Inventors: Jean Baravian, Croissy sur Seine; Jacques Barbey, Beynost Miribel, both of France

[73] Assignee: Rhone-Poulenc Fibres, Lyon, France

[21] Appl. No.: 612,344

[22] Filed: May 21, 1984

[30] Foreign Application Priority Data

May 25, 1983 [FR] France ..... 83 08769

[51] Int. Cl.[3] ..... B32B 11/02

[52] U.S. Cl. ..... 428/291; 427/443; 428/296; 428/300; 428/373; 428/374

[58] Field of Search ..... 428/291, 296, 373, 374, 428/300; 264/103, 176 F; 427/443

[56] References Cited

U.S. PATENT DOCUMENTS 4,035,544 7/1977 Iwasaki et al. ..... 428/291

FOREIGN PATENT DOCUMENTS 58-190 1/1983 Japan ..... 428/291

*Primary Examiner*—Marion E. McCamish

*Attorney, Agent, or Firm*—Sherman & Shalloway

[57] ABSTRACT

A waterproof membrane consisting of a non-woven bitumen-coated reinforcement of heat-bonded continuous filaments containing:

from 70 to 90% of polyethylene glycol terephthalate and from 30 to 10% of polybutylene glycol terephthalate.

The filaments are two-component and either concentric or side-by-side. The membrane consists of filaments made of each of the two types of polymers. The process for its manufacture by heat bonding.

Application in the building industry (roofs, terraces, floors and any waterproofing application).

8 Claims, No Drawings

WATERPROOF MEMBRANE WITH FUSE BONDED NON-WOVEN REINFORCEMENT

The present application relates to a waterproof membrane based on nonwovens made of continuous filaments, and to the process for its manufacture.

Waterproof membranes for flat roofs, used in the building industry, commonly consist of a bitumen-coated substrate. These substrates were initially woven jute fabrics, cellulose felts and then webs of glass fibres.

A few years ago, a new generation of waterproof products appeared due to the spectacular improvement in the bitumens modified by plastomers and/or elastomers, leading to very high deformabilities of these modified bitumens. The conjoint use of a reinforcement based on nonwovens made of polyester textile, mainly polyethylene glycol terephthalate, satisfying the requirements of enhanced deformability and permitting a better tolerance of the dimensional changes of the substrates, together with a very considerable increase in the punching resistances of the bitumen/reinforcement composites produced in this way, made it possible to improve waterproof membranes.

However, the nonwovens are most commonly bonded chemically to one another before being coated with bitumen, and this bonding operation, which can lead to advantageous results in industrial terms, is expensive and also uses special compositions of chemical products.

Furthermore, this does not give a perfectly satisfactory result from the point of view of the subsequent behaviour of the sheets, such as, in particular, the dimensional stability, and more precisely for reinforcements weighing 150 g/m$^2$ or less; thus, for the lighter reinforcements, numerous manufacturers of waterproof membranes use a double polyester non-woven reinforcement associated with a glass web in order to restrict the deformations of the polyester during impregnation with bitumen and hence to improve the dimensional stability of the laid waterproof material to ageing cycles.

The present application proposes a reinforcement for a waterproof membrane and a membrane produced with this reinforcement, having good dimensional stability characteristics and, furthermore, produced under advantageous economic conditions. The present application relates to a waterproof membrane consisting of a bitumen-coated reinforcement, characterized in that the reinforcement is a nonwoven of heat-bonded continuous filaments containing:

from 70 to 90% of polyethylene glycol terephthalate and from 30 to 10% of polybutylene glycol terephthalate.

The nonwoven of the present application is preferably needle-bonded.

The two polymers in the mixture can be distributed as follows: it is possible to have 70 to 90% of continuous filaments of one polymer and 30 to 10% of continuous filaments of the other polymer, or alternatively the filaments are two-component filaments with a core/sheath structure (the sheath consisting of the polymer of lower melting point) or a side-by-side structure, or alternatively there is a superposition of sheets, each consisting of filaments made of different polymers.

The present application also relates to a process for the manufacture of the reinforcement, characterized in that a sheet of continuous filaments consisting of the two polymers is produced by extrusion, in that the sheet obtained is optionally needle-bonded and in that it is then heat-bonded continuously at a temperature of between 220° and 240° C., causing the melting of the constituent of lower melting point.

The present application also relates to a process for the production of a waterproof membrane, characterized in that the reinforcement is coated with bitumen at a temperature below the heat bonding temperature of the filaments of the sheet. After bitumen coating, the whole is optionally subjected to the usual treatments such as sand blasting or slate blasting.

The use of polybutylene glycol terephthalate, which has a melting point of about 225° C., permits good heat bonding; it acts as a binder which is not adversely affected by hot bitumen and it enables the reinforcement to retain its flexibility; the textile in the final product obtained is not degraded and thus makes it possible to retain a good dimensional stability in use. The integration of the heat bonding operation continuously thus makes it possible to produce the reinforcement economically in a single operation; furthermore, the heat bonding reduces the energy cost of manufacturing the reinforcement by a factor of about 1 to 8 compared with chemical bonding.

The bitumens employed are oxidized bitumens or bitumens modified by plastomers and/or elastomers.

The process for the manufacture of the sheet is a known process of extrusion of the filaments onto a deflector making it possible to open the bundle of filaments, which are then deposited on an endless apron; according to the application, on leaving the apron, the web optionally passes through a needle-felting machine and is then heat-bonded, for example by calendering at a temperature of 220° to 240° C., in order to cause the heat bonding of the filaments. Extrusion can be carried out using dies placed side-by-side and extruding the two types of polymers through each one; the filaments obtained are then either stretched separately and deposited on the deflector, or alternatively combined and stretched together in order to improve the mixing of the filaments of the two constituents; it is also possible to extrude through dies in which the two types of polymers are distributed between the die orifices; it is also possible to use the process and device forming the subject of French Pat. No. 2,299,438 of the applicant Company.

The waterproof membrane of the present application is used for all waterproofing problems in the building industry, that is to say for terraces, substructures, facades, foundations and floors, and it can also be used for the waterproofing of water tanks, swimming pools and the like.

The examples which follow illustrate the present application without limiting it.

EXAMPLE 1

A butylene glycol terephthalate polymer and an ethylene glycol terephthalate polymer are extruded through dies arranged side-by-side, and in order from one die to the other, the filaments obtained are in the distribution of 80% of polyethylene glycol terephthalate and 20% of polybutylene glycol terephthalate, the linear density of the filaments is 5.6 dtex, the filaments are assembled in pairs of polymers and pass through a pneumatic stretching nozzle such as that forming the subject of French Pat. No. 1,582,147 of the Applicant Company, and are then projected onto a deflector, the open bundle being recovered by an endless apron. The sheet then passes through a needle-felting machine permitting the mechanical bonding of the filaments:

density of needle bonding: 80 performations/$cm^2$
type of needle: 38 MB from SINGER.

On leaving the needle-felting machine, the sheet is calendered at 235° C., under a pressure of 25 kg/linear cm, on a calender equipped with teflon-coated rollers: accurately adjusted nip between the two rollers of 15/100 mm, calendering speed of 12 m/minute, S pass, total contact time of the sheet with the two rollers of 14 seconds, followed by passage over cooling rollers and winding.

The characteristics of the reinforcement obtained are as follows:

Width of the sheet: 100 centimeters
Weight of the sheet: 140 g/$m^2$
Thickness: 0.55 mm
Coefficient of variation of the surface density: Less than 7 (measured on a square of 5×5 cm)
Tensile strength
longitudinal direction: 44 daN (according to French Standard G 07 001)
transverse direction: 38 daN
Elongation at break
longitudinal direction: 32% (according to French Standard G 07 001)
transverse direction: 38%
Thermal contraction in a ventilated oven on 20×20 cm samples after 15 minutes at 200° C.:
0.4% longitudinal direction
0% transverse direction The reinforcement obtained is close to isotropy.

Bitumen coating is then carried out with an oxidized bitumen in two stages:

first stage: impregnation followed by draining, with a straight-run bitumen, at 190° C.,
second stage: surfacing on both sides with an oxidized bitumen, at 180° C.;

the product is then sand-blasted on both sides.

During this impregnation, the transverse contraction does not exceed 1%, whereas products produced from nonwovens made of polyethylene glycol terephthalate, having the same weight and chemically bonded, have contractions of the order of 1.5 to 2%.

The characteristics of the bitumen-coated product are as follows:

Weight per $m^2$: 1.8 kilograms
Tensile strength
longitudinal direction: 52 daN
transverse direction: 46 daN
Elongation at break
longitudinal direction: 35%
transverse direction: 39%

EXAMPLE 2

Two-component (side-by-side) filaments of polybutylene glycol terephthalate and polyethylene glycol terephthalate are extruded simultaneously through a die in the proportion 15/85, and the filaments then pass together through a stretching nozzle such as that forming the subject of French Pat. No. 1,582,147 of the applicant company, and then through a device described in French Pat. No. 2,299,438 of the applicant company. The linear density of the filaments is 4.5 dtex and the sheet obtained is needle-bonded: density of needle bonding: 40 perforations per $cm^2$, with 36 RB needles from JAECKER.

The filaments are heat-bonded using a teflon-coated roller of diameter 900 mm at 236° C., the speed of the sheet being 9 m/minute; over three-quarters of its circumference, the roller is covered with an endless belt made of stable textile, exerting a pressure of 2 daN/$cm^2$ on the roller; the sheet is cooled by means of rollers and the reinforcement obtained is then wound up.

The reinforcement thus obtained has the following characteristics:

Weight: 100 g/$m^2$
Width: 200 cm split into two 100 cm sheets on leaving the cooling rollers
Thickness: 0.45 mm
Coefficient of variation: less than 6
Tensile strength
longitudinal direction: 31 daN
transverse direction: 27 daN
Elongation at break
longitudinal direction: 35%
transverse direction: 40%
Thermal contraction as in Example 1:
longitudinal direction: 0.5%
transverse direction: 0%

The sheet is then passed together with a glass fibre web of 40 g/$m^2$ through a bitumen bath to which styrene/butadiene/styrene has been added, at 180° C., this being followed by surfacing in a bitumen bath of the same type, but containing inorganic fillers, at 178° C. The reinforcement has a zero contraction on the machine.

The characteristics of the waterproof membrane are as follows:

Weight: 1.8 g/$m^2$
Tensile strength
longitudinal direction: 45 daN
transverse direction: 36 daN
Elongation at break
longitudinal direction: 45%
transverse direction: 52%

EXAMPLE 3

Using the process and device forming the subject of French Pat. No. 2,299,438 of the applicant company, a reinforcement is produced by the extrusion of filaments in which the two polymers are coaxial, comprising 83% of polyethylene glycol terephthalate in the core and 17% of polybutylene glycol terephthalate in the sheath.

The sheet obtained is needle-bonded, at a rate of 60 perforations per square centimeter, with 40 RB needles from JAECKER.

On leaving the needle-felting machine, the sheet is treated with hot air at 240° C. on a perforated drum with central suction, possessing an endless metal belt making it possible to compress the sheet slightly; the sheet heat-bonded in this way then passes between the rollers of a calender heated to 230° C., the nip being 20/100 mm in a straight pass, this being followed by cooling on rollers and winding.

The sheet has the following characteristics:

Weight: 180 g/$m^2$
Width of the sheet: 100 cm
Thickness: 0.70 mm
Coefficient of variation: less than 5
Tensile strength
longitudinal direction: 57 daN
transverse direction: 54 daN
Elongation at break
longitudinal direction: 36% transverse direction: 37%

This reinforcement is used to produce a covering by impregnation in a single bath containing atactic polypropylene bitumen at 190° C., followed by sizing between two metal rollers and cooling on a bed of water. The contraction of the reinforcement on the machine is 0.6%.

The characteristics of the waterproof membrane thus obtained are:

Weight: 4.5 kg/m$^2$

Tensile strength longitudinal direction: 78 daN transverse direction: 65 daN

Elongation at break longitudinal direction: 49% transverse direction: 45%

What is claimed is:

1. A waterproof membrane consisting of a bitumen-coated reinforcement, characterized in that the reinforcement is a nonwoven of heat-bonded continuous filaments containing:

from 70 to 90% of polyethylene glycol terephthalate and from 30 to 10% of polybutylene glycol terephthalate.

2. A waterproof membrane according to claim 1, characterized in that, in the reinforcement, the filaments consist of 70 to 90% of polyethylene glycol terephthalate filaments and 30 to 10% of polybutylene glycol terephthalate filaments.

3. A waterproof membrane according to claim 1, characterized in that, in the reinforcement, the filaments are two-component filaments comprising 70% to 90% of polyethylene glycol terephthalate and 30 to 10% of polybutylene glycol terephthalate.

4. A waterproof membrane according to claim 3, characterized in that, in the two-component filaments, the polymers are arranged side-by-side.

5. A waterproof membrane according to claim 3, characterized in that, in the two-component filaments, the polymers are in a core/sheath arrangement, the polybutylene glycol terephthalate forming the sheath.

6. A waterproof membrane according to claim 1, characterized in that its reinforcement is needle-bonded before heat-bonding.

7. A process for the manufacture of the reinforcement for the waterproof membrane according to claim 1, characterized in that a sheet of continuous filaments of the two polymers is produced by extrusion, in that the sheet obtained is optionally needle-bonded and in that it is then subjected to continuous thermal calendering at a temperature of between 220° C. and 240° C., permitting the melting of the component of lower melting point in order to cause the heat bonding of the filaments.

8. A process for the manufacture of the waterproof membrane forming the subject of claim 1, characterized in that the reinforcement is coated with bitumen at a temperature below the heat bonding temperature of the filaments of the said reinforcement, this optionally being followed by sand-blasting and slate-blasting.

* * * * *